US009670027B2

(12) United States Patent
Yokobori

(10) Patent No.: US 9,670,027 B2
(45) Date of Patent: Jun. 6, 2017

(54) SHEET DISCHARGING APPARATUS AND IMAGE FORMING APPARATUS

(71) Applicant: CANON KABUSHIKI KAISHA, Tokyo (JP)

(72) Inventor: Yuya Yokobori, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/000,277

(22) Filed: Jan. 19, 2016

(65) Prior Publication Data

US 2016/0214822 A1 Jul. 28, 2016

(30) Foreign Application Priority Data

Jan. 22, 2015 (JP) ..... 2015-010226
Jan. 22, 2015 (JP) ..... 2015-010227
Dec. 25, 2015 (JP) ..... 2015-255186

(51) Int. Cl.
*B65H 29/70* (2006.01)
*B65H 29/12* (2006.01)
*B65H 29/14* (2006.01)
*B65H 29/52* (2006.01)

(52) U.S. Cl.
CPC ..... *B65H 29/70* (2013.01); *B65H 29/125* (2013.01); *B65H 29/14* (2013.01); *B65H 29/52* (2013.01); *B65H 2301/5122* (2013.01); *B65H 2301/51214* (2013.01); *B65H 2402/10* (2013.01); *B65H 2402/5154* (2013.01);
(Continued)

(58) Field of Classification Search
CPC ..... B65H 29/70; B65H 2301/5121; B65H 2301/5122; B65H 2405/111; B65H 2405/1113; B65H 31/00
USPC ..... 271/188, 209
See application file for complete search history.

(56) References Cited

U.S. PATENT DOCUMENTS 5,194,904 A * 3/1993 Ruch ..... G03G 15/6552 162/269
5,312,108 A * 5/1994 Hayashi ..... B65H 29/70 271/188
(Continued)

FOREIGN PATENT DOCUMENTS

JP 2005-126149 A 5/2005
JP 2007-119110 A 5/2007
JP 2009-190809 A 8/2009

*Primary Examiner* — David H Bollinger
(74) *Attorney, Agent, or Firm* — Fitzpatrick, Cella, Harper & Scinto

(57) ABSTRACT

A sheet discharging apparatus includes an apparatus body, a discharge unit discharging a sheet out of the apparatus body, and a sheet stacking portion including a stacking surface on which the sheet discharged by the discharge unit is stacked. A sheet processing device processing the sheet discharged by the discharge unit can be mounted on the sheet stacking portion. The sheet discharging apparatus further includes a stiffness imparting unit removably attached to the apparatus body and imparting stiffness to the sheet discharged by the discharge unit. The stiffness imparting unit includes a pressing portion pressing and deflecting the sheet in a width direction intersecting with a sheet discharging direction and a projecting portion projecting from the apparatus body above the stacking surface such that at least a part of the projecting portion overlaps with the stacking surface in a plan view.

20 Claims, 8 Drawing Sheets

(52) U.S. Cl.
CPC ..... *B65H 2402/5155* (2013.01); *B65H 2404/1521* (2013.01); *B65H 2404/61* (2013.01); *B65H 2801/06* (2013.01)

(56) References Cited

U.S. PATENT DOCUMENTS

| | | | | |
|---|---|---|---|---|
| 5,653,439 | A * | 8/1997 | Rider | B65H 29/70 271/188 |
| 7,200,356 | B2 * | 4/2007 | Kawamoto | G03G 15/6576 271/188 |
| 7,243,913 | B2 * | 7/2007 | Terao | B65H 29/52 270/58.08 |
| 7,954,806 | B2 | 6/2011 | Saito | |
| 8,267,402 | B2 | 9/2012 | Saito | |
| 8,480,074 | B2 | 7/2013 | Ubayashi et al. | |
| 8,740,214 | B2 | 6/2014 | Onodera et al. | |
| 8,820,735 | B2 * | 9/2014 | Ishikawa | B65H 29/52 271/188 |
| 2015/0202903 | A1 * | 7/2015 | Arakane | B41J 2/2135 347/14 |
| 2015/0274475 | A1 * | 10/2015 | Ohta | B65H 29/22 271/306 |
| 2015/0375956 | A1 * | 12/2015 | Arimura | B65H 29/52 271/3.17 |

* cited by examiner

SHEET DISCHARGING APPARATUS AND IMAGE FORMING APPARATUS

BACKGROUND OF THE INVENTION

Field of the Invention

Lately, an image forming apparatus such as a scanner, a copier, a printer, and a facsimile is required to be able to form an image on various types of sheets and to be able to discharge the sheet orderly on a sheet discharge tray. However, in a case when a sheet with relatively small (weak) stiffness is discharged to the sheet discharge tray, a front end of the sheet might hang down under its own weight and the sheet is not stacked orderly on the sheet discharge tray.

Description of the Related Art

Lately, an image forming apparatus such as a scanner, a copier, a printer, and a facsimile is required to be able to form an image on various types of sheets and to be able to discharge the sheet orderly on a sheet discharge tray. However, in a case when a sheet with relatively small (weak) stiffness is discharged to the sheet discharge tray, a front end of the sheet might hangs down under its own weight and the sheet is not stacked orderly on the sheet discharge tray.

Then, Japanese Patent Application Laid-open No. 2009-190809 discloses an image forming apparatus including a sheet discharging apparatus having a stiffness imparting unit, which imparts stiffness to a sheet by pressing and bending the sheet in a width direction intersecting with a sheet discharging direction.

By the way, there is a case when a sheet processing device, which conducts such process as stapling on a sheet on which an image has been formed, is mounted on the sheet discharge tray of the image forming apparatus. Here, in a case in which a sheet with a curve in the width direction is conveyed to the sheet processing device, the sheet might cause jamming within the sheet processing device or damage of the image for coming into contact with a member near a conveyance path. Then, it is preferable to take the stiffness imparting unit out of the sheet discharging apparatus in advance of mounting the sheet processing device on the sheet discharge tray. However, such jamming of the sheet and damage of the image as described above might occur in a case where an user erroneously mounts the sheet processing device on the sheet discharge tray while the stiffness imparting unit remains assembled in the sheet discharging apparatus.

SUMMARY OF THE INVENTION

According to one aspect of the invention, a sheet discharging apparatus includes an apparatus body, a discharge unit discharging a sheet out of the apparatus body, and a sheet stacking portion including a stacking surface on which the sheet discharged by the discharge unit is stacked. A sheet processing device processing the sheet discharged by the discharge unit can be mounted on the sheet stacking portion. The sheet discharging apparatus further includes a stiffness imparting unit removably attached to the apparatus body and imparting stiffness to the sheet discharged by the discharge unit. The stiffness imparting unit includes a pressing portion pressing the sheet to bend the sheet in a width direction intersecting with a sheet discharging direction and a projecting portion projecting from the apparatus body above the stacking surface such that at least a part of the projecting portion overlaps with the stacking surface in a plan view.

According to a second aspect of the invention, an image forming apparatus includes an apparatus body, an image forming unit forming an image on a sheet, a sheet discharging apparatus discharging the sheet on which the image has been formed by the image forming unit, and a sheet stacking portion including a stacking surface on which the sheet discharged by the sheet discharging apparatus is stacked. A stiffness imparting unit can be attached to the apparatus body. The stiffness imparting unit includes a pressing portion pressing the sheet to bend the sheet in a width direction intersecting with a sheet discharging direction. The stiffness imparting unit also includes a projecting portion projecting out of the apparatus body and disposed above the stacking surface such that at least a part thereof overlaps with the stacking surface in a plan view. A sheet processing device processing the sheet discharged by the sheet discharging apparatus is mounted on the sheet stacking portion in a state in which the stiffness imparting unit is taken out of the apparatus body.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
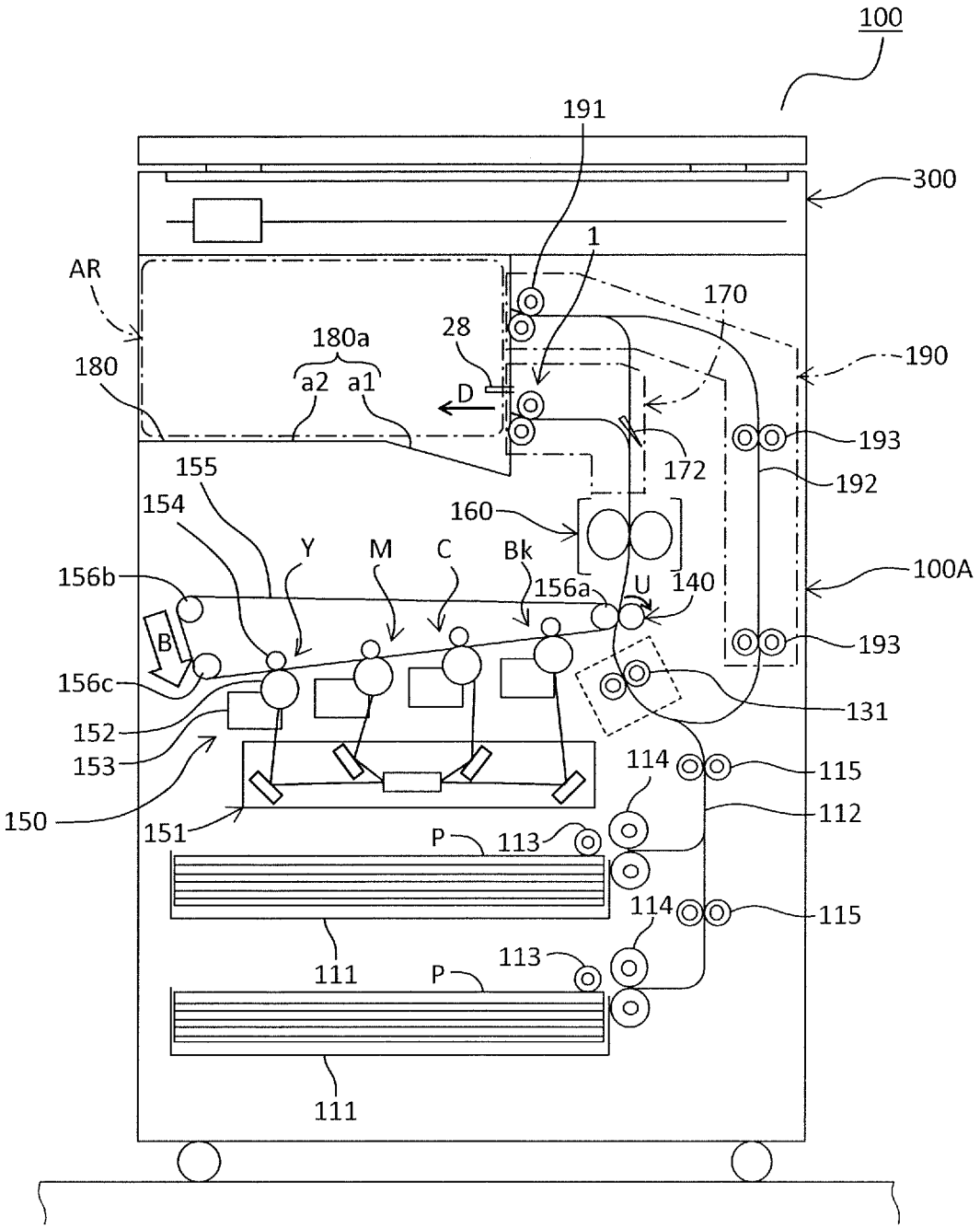
FIG. 1 is a schematic diagram illustrating a configuration of a printer, i.e., an image forming apparatus, including a sheet discharging apparatus according to the present embodiment.

A sheet discharging apparatus and an image forming apparatus including the sheet discharging apparatus according to the present embodiment will be described below with reference to the drawings. FIG. 1 is a schematic diagram illustrating a configuration of a printer, i.e., an image forming apparatus, including the sheet discharging apparatus of the embodiment. The printer 100 includes, in order from a lower part to an upper part within an apparatus body 100A, a sheet cassette 111, an image forming portion 150, a fixing unit 160, the sheet discharging apparatus 170 and others. The printer 100 also includes a reverse conveyance unit 190 at a lateral position (on the right side in FIG. 1) of the fixing unit 160. The printer 100 also includes a sheet guide path 112 guiding a sheet from the sheet cassette 111 to the sheet discharging apparatus 170 and also to the reverse conveyance unit 190. The printer 100 also includes an image reading apparatus 300 above the apparatus body 100A. The printer 100 is provided with an operation panel (not shown) to be operated by a user at a front side of the printer 100.

The sheet cassette 111 storing the sheet P is drawably stored in the apparatus body 100A. The sheet cassette 111 also includes a lift mechanism (not shown) lifting the stored sheet. Disposed above the sheet cassette 111 is a pickup roller 113. The pickup roller 113 comes into contact with the sheet P pushed up by the lift mechanism and rotates to deliver an uppermost sheet out of the sheet cassette 111 to a sheet guide path 112. The sheet P delivered to the sheet guide path 112 is conveyed to a registration roller pair 131 by a sheet separating roller pair 114 and a conveying roller pair 115 respectively provided along the sheet guide path 112. If the sheets delivered out of the sheet cassette 111 overlap with each other, the sheet separating roller pair 114 separates the sheets one by one and conveys the uppermost among overlapped sheets to the conveying roller pair 115. If the sheet is askew, the registration roller pair 131 corrects and straights up the sheet and then conveys the sheet to the image forming portion 150.

The image forming portion 150, i.e., an image forming unit, adopts a four-drum full-color system and is configured to be able to superimpose and transfer four color toner images of yellow (Y), magenta (M), cyan (C), and black (Bk) to the sheet. The image forming portion 150 includes a laser scanner unit 151, photosensitive drums 152, developing devices 153, primary transfer rollers 154, an intermediate transfer belt 155, a secondary transfer roller 140, and others. The photosensitive drum 152, the developing device 153, and the primary transfer roller 154 are provided by four each in the image forming portion 150 to form the four color toner images. The intermediate transfer belt 155 circulates in a direction of an arrow B by being guided and driven by a driving roller 156*a*, driven rollers 156*b* and 156*c* and passes through between the photosensitive drums 152 and the primary transfer rollers 154 and between the secondary transfer roller 140 and the driving roller 156*a*.

The printer 100 processes image information, which is transmitted from an outside or from the image reading apparatus 300, with a controller (not shown). Then, based on a signal obtained from the processing result of the image information, the printer 100 irradiates the photosensitive drum 152 of each color with a laser beam from the laser scanner unit 151 to form an electrostatic latent image on the photosensitive drum 152. The electrostatic latent image is developed with toner and visualized as a toner image by the developing device 153. Then, a predetermined pressure and an electrostatic negative bias are applied to the primary transfer roller 154 of each color, and the toner images on the four color photosensitive drums 152 are superimposed and transferred from the photosensitive drums 152 to the circulating intermediate transfer belt 155. As a result, a full-color toner image is formed on the intermediate transfer belt 155 and is then conveyed to the secondary transfer roller 140. By this time, the registration roller pair 131 described above starts to send the sheet between the intermediate transfer belt 155 and the secondary transfer roller 140 while synchronizing with a position of the toner image. Then, the full-color toner image on the intermediate transfer belt 155 is transferred to the sheet during when the sheet passes between the intermediate transfer belt 155 rotating in a direction of an arrow B and the secondary transfer roller 140 rotating in a direction of an arrow U.

The sheet on which the toner image has been transferred undergoes heat and pressure in the fixing unit 160 to fix the toner image thereon and the sheet is discharged onto a sheet discharge tray 180 by a sheet discharging roller pair 1 of the sheet discharging apparatus 170. The sheet discharge tray 180 provided in a space into which the sheet is discharged, i.e., a sheet stacking portion, includes a sheet stacking surface 180*a*, i.e., a stacking surface, on which the sheet discharged by the sheet discharging roller pair 1 is stacked. The sheet discharge tray 180 is a so-called in-body discharge tray provided by forming a space AR (sheet stacking portion), into which the sheet is discharged, within an occupancy space of the apparatus body 100A. Here, the occupancy space is a space located inside of an outline of the apparatus seen in vertical and horizontal directions. The occupancy space of the apparatus body 100A of the present embodiment is formed substantially into a rectangular parallelepiped shape.

In a case of forming toner images on both surfaces of a sheet, the sheet is guided to the reverse conveyance unit 190 by a switching member 172. The sheet conveyed to the reverse conveyance unit 190 is conveyed by a reversing roller pair 191 located above the sheet discharging roller pair 1 such that front end and middle parts of the sheet project above the sheet discharge tray 180 while leaving a rear end part within the apparatus body 100A. Then, in response to reversal of the reversing roller pair 191, the sheet is conveyed to a reverse guide path 192. That is, the sheet is switched back and turned over. The turned-over sheet is then conveyed through the reverse guide path 192 to the registration roller pair 131 by a reverse conveying roller pair 193.

The registration roller pair 131 sends the turned-over sheet between the intermediate transfer belt 155 and the secondary transfer roller 140 by synchronizing with a position of a full-color toner image formed on the intermediate transfer belt 155. The full-color toner image on the intermediate transfer belt 155 is then transferred to a back surface of the sheet. The sheet is then sent to the fixing unit 160 to fix the toner image. Finally, the sheet is discharged onto the sheet discharge tray 180 by the sheet discharging roller pair 1. Thus, the toner images are formed on the both surfaces of the sheet. It is noted that in the configuration described above, the image forming portion 150 and the fixing unit 160 compose an image forming unit.

Figure 2:
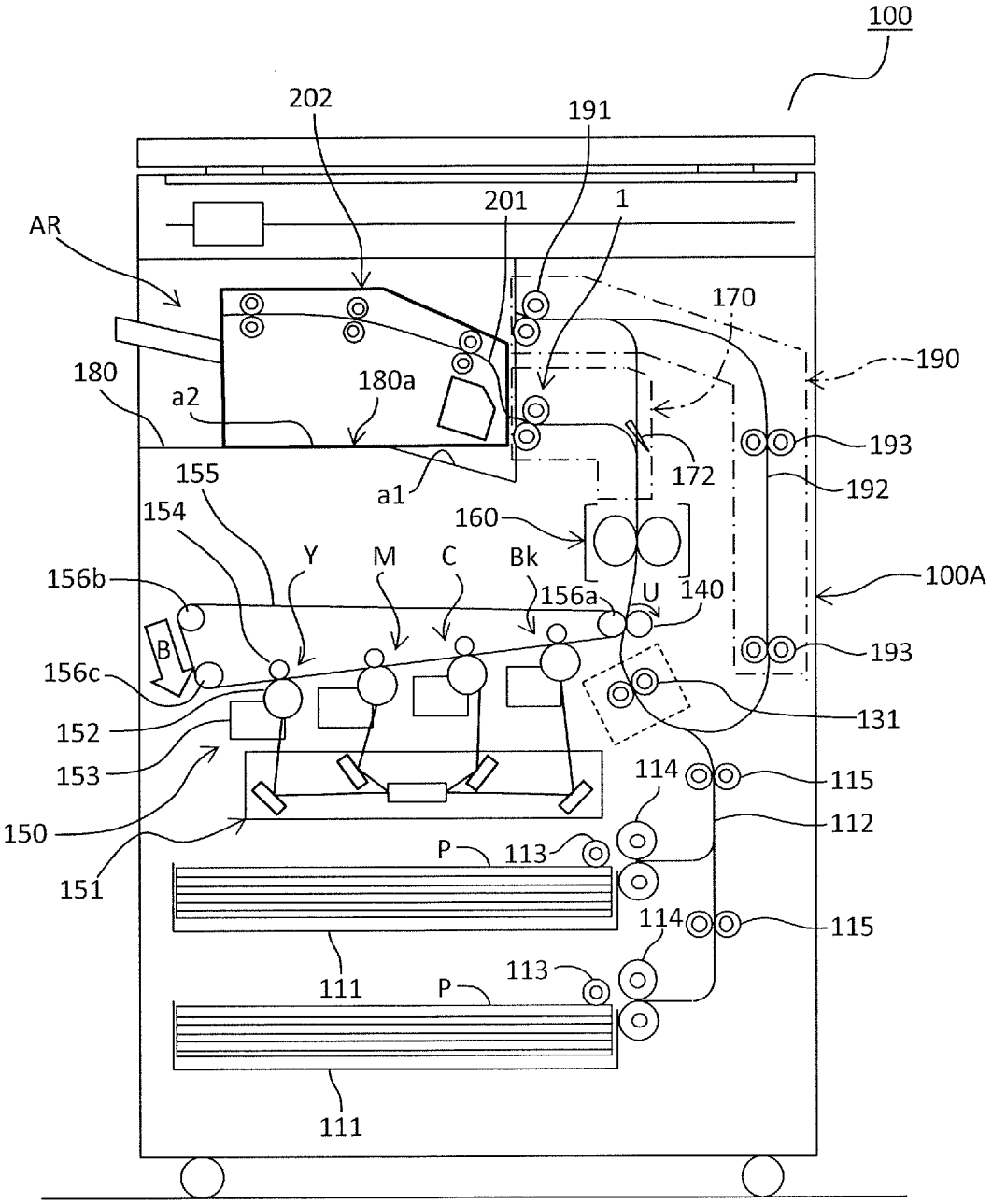
FIG. 2 is a schematic diagram illustrating the image forming apparatus with a stapler according to the present embodiment.

The printer 100 is mountable with a stapler 202, i.e., a processing device, processing the sheet discharged by the sheet discharging apparatus 170 as shown in FIG. 2. The sheet stacking surface 180*a* of the sheet discharge tray 180 is composed of an inclined part a1 inclined upward toward a downstream in a sheet discharging direction and a supporting part a2 adjacent to a downstream side of the inclined part a1 and extending in a horizontal direction so as to be able to support a bottom part of the stapler 202. Accordingly, the stapler 202 can be disposed within the space AR by mounting on the supporting part a2. The stapler 202 conducts a stapling process of binding a plurality of sheets on which images have been formed by the printer 100 and discharges the stapled sheet bundle.

Figure 3:
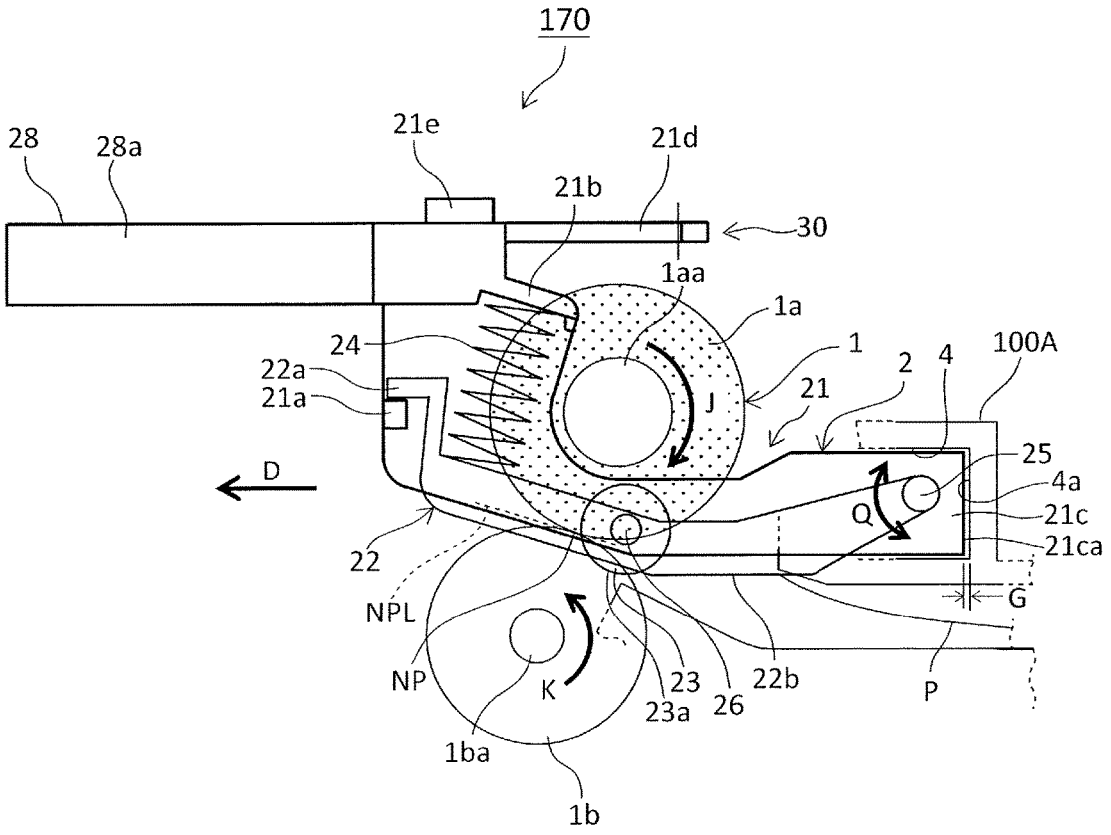
FIG. 3 is a section view of the sheet discharging apparatus according to the present embodiment taken along a sheet discharging direction.
Figure 4:
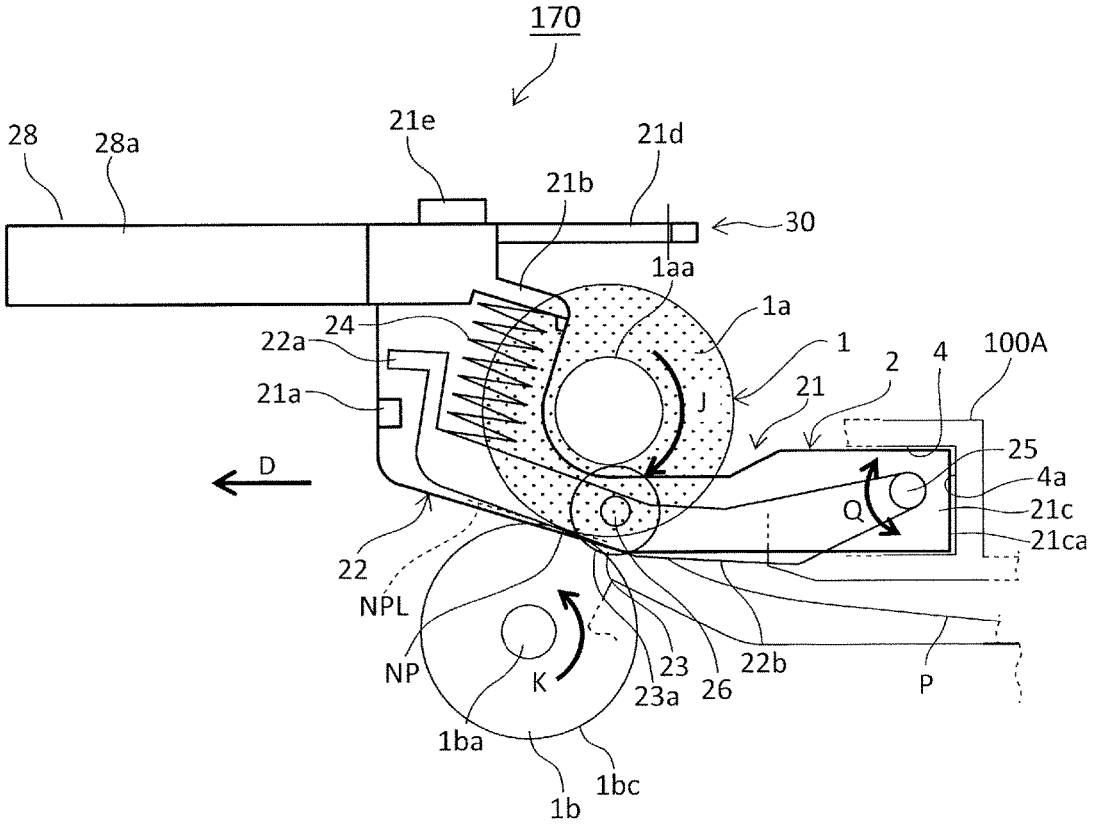
FIG. 4 is a section view, of the sheet discharging apparatus in starting to discharge a sheet according to the present embodiment taken along the sheet discharging direction.
Figure 5:
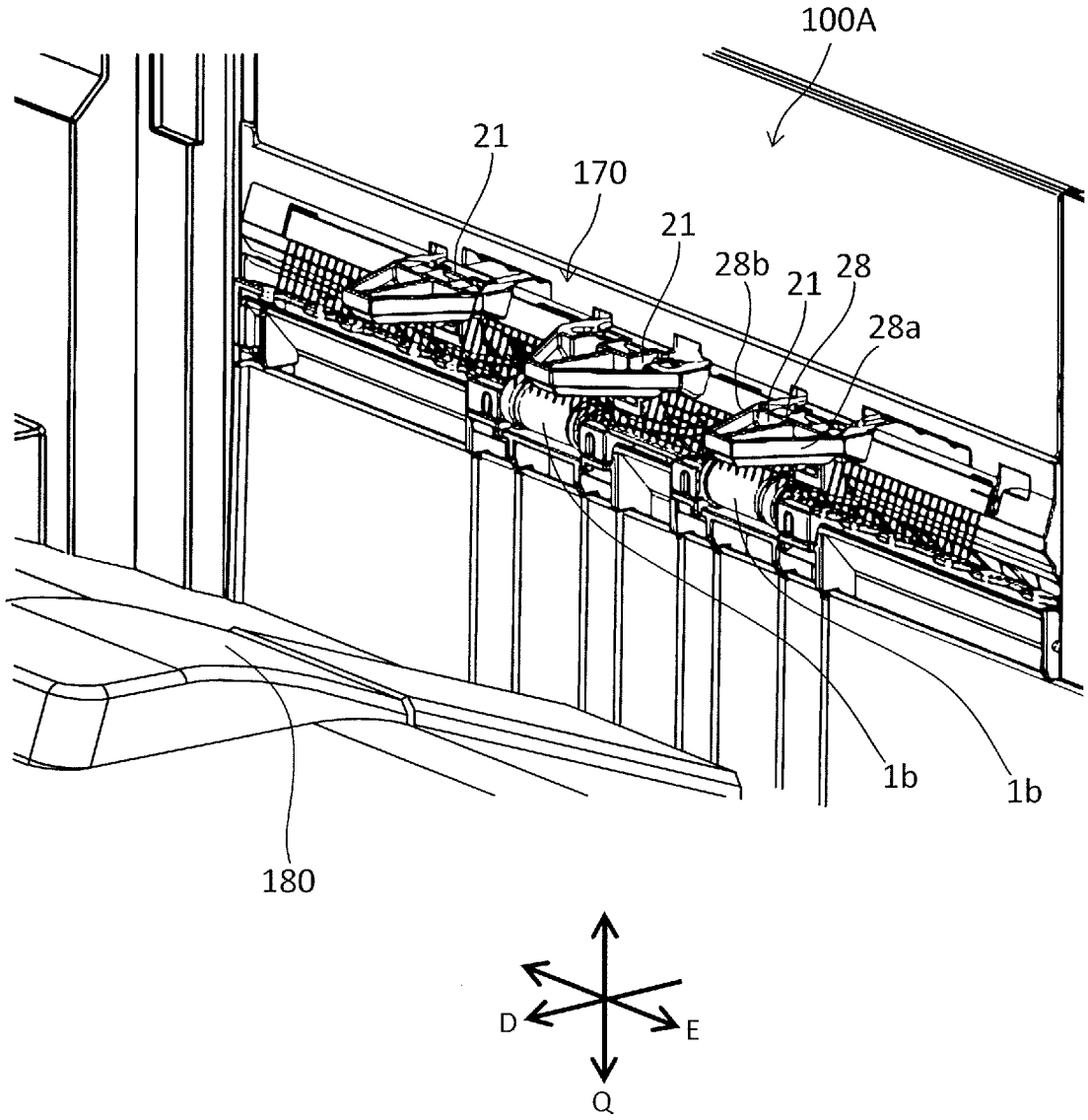
FIG. 5 is a perspective view of the sheet discharging apparatus according to the present embodiment seen from the outside of the printer.
Figure 6:
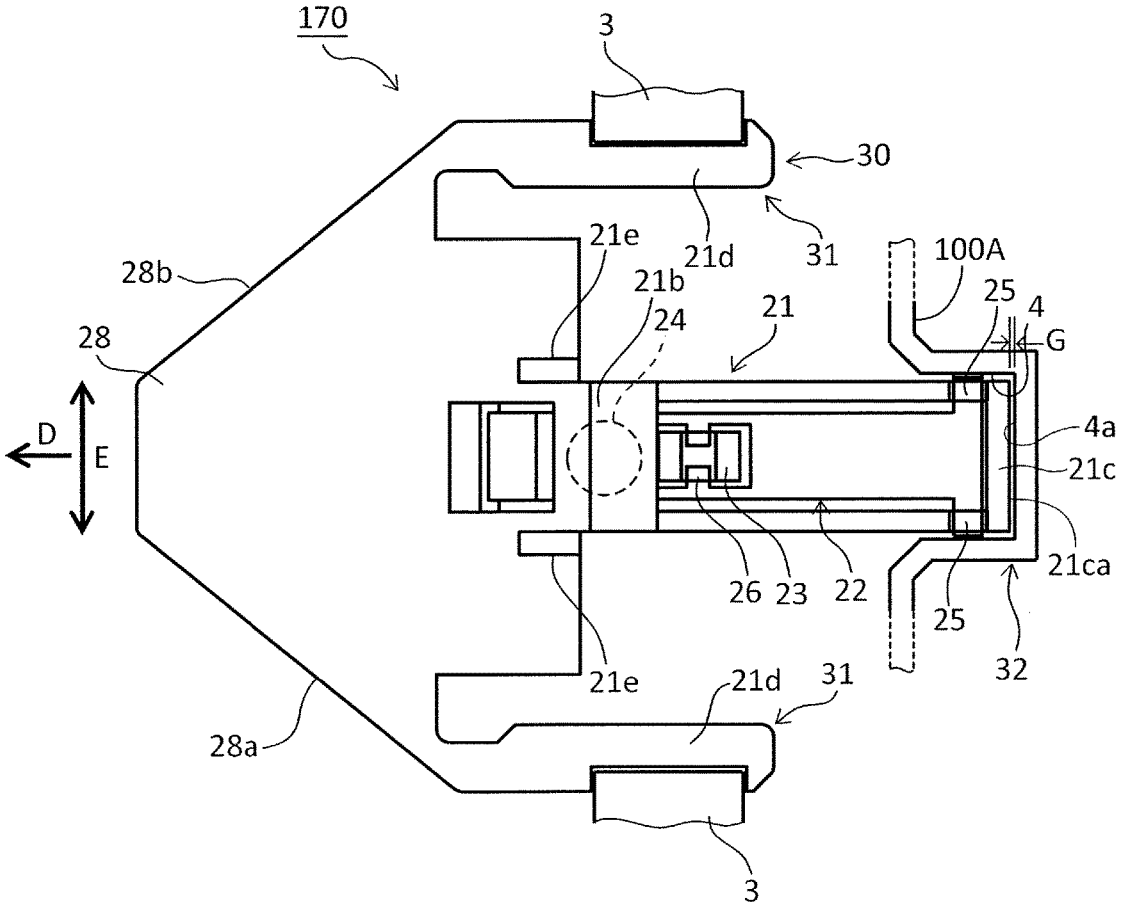
FIG. 6 is a plan view illustrating a part of the sheet discharging apparatus according to the present embodiment.
Figure 7:
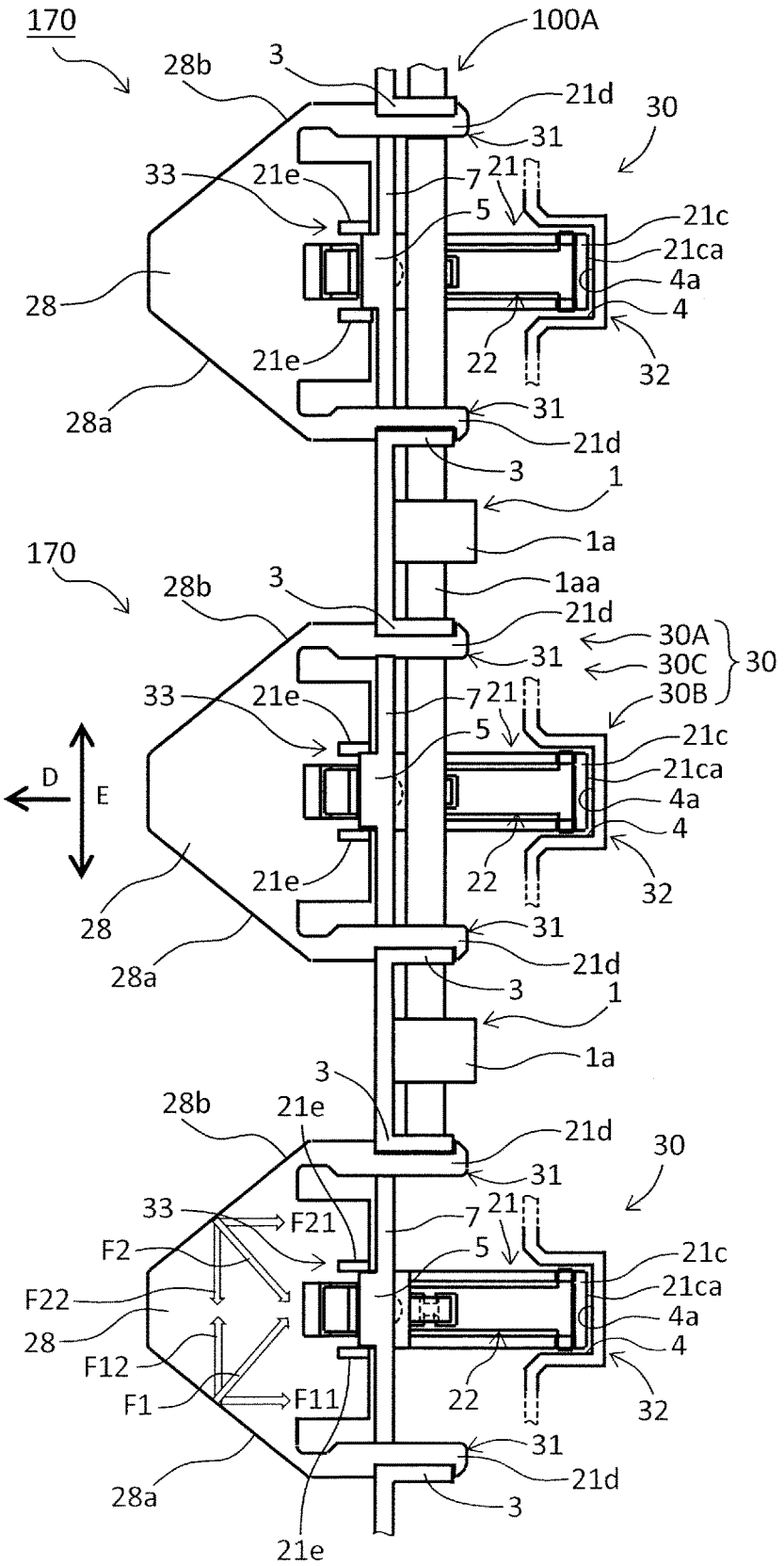
FIG. 7 is a plan view of the sheet discharging apparatus according to the present embodiment.
Figure 8:
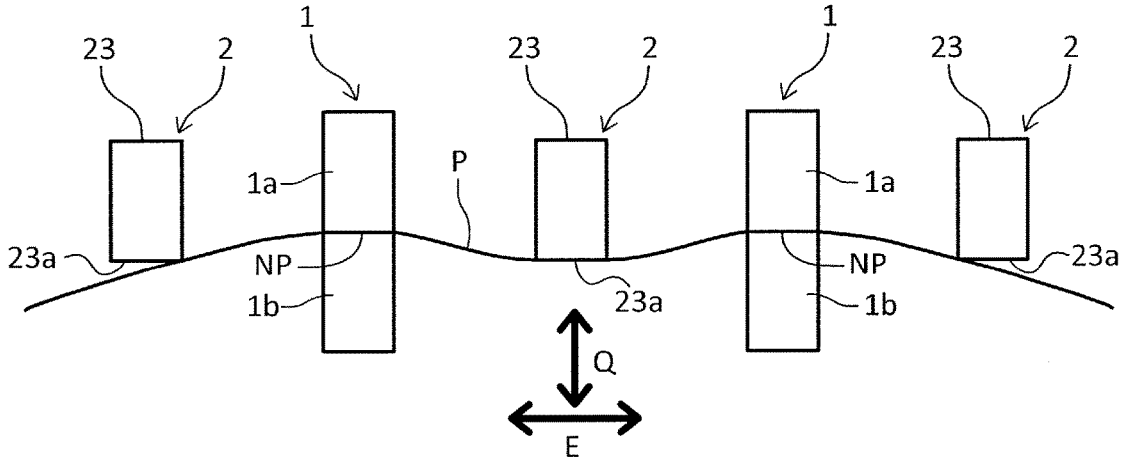
FIG. 8 is a schematic diagram illustrating deflection of a sheet affected by a stiffening unit of the embodiment.

Next, the sheet discharging apparatus 170 will be described below with reference to FIGS. 2 through 8. FIG. 2 is a schematic diagram illustrating the printer 100 in a state in which the stapler 202 is mounted on the sheet discharge tray 180. FIG. 3 is a section view of the sheet discharging apparatus 170 taken along the sheet discharging direction D. FIG. 4 is a section view a section view of the sheet discharging apparatus 170 just before starting to discharge a sheet. FIG. 5 is a perspective view of the sheet discharging apparatus 170 seen from an outside of the printer 100. FIG. 6 is a plan view illustrating a part of the sheet discharging apparatus 170. FIG. 7 is a plan view of the sheet discharging apparatus 170. FIG. 8 is a schematic diagram illustrating deflection of a sheet affected by a stiffness imparting unit 2.

Next, the sheet discharging apparatus 170 will be described below with reference to FIGS. 2 through 8. FIG. 2 is a schematic diagram illustrating the printer 100 in a state in which the stapler 202 is mounted on the sheet discharge tray 180. FIG. 3 is a section view of the sheet discharging apparatus 170 taken along the sheet discharging direction D. FIG. 4 is a section view of the sheet discharging apparatus 170 just before starting to discharge a sheet. FIG. 5 is a perspective view of the sheet discharging apparatus 170 seen from an outside of the printer 100. FIG. 6 is a plan view illustrating a part of the sheet discharging apparatus 170. FIG. 7 is a plan view of the sheet discharging apparatus 170. FIG. 8 is a schematic diagram illustrating deflection of a sheet affected by a stiffness imparting unit 2.

The sheet discharging apparatus 170 includes the sheet discharging roller pair 1, i.e., a discharge unit, and a stiffness imparting unit 2 imparting stiffness to the sheet discharged by the sheet discharging roller pair 1. As shown in FIG. 8, a plurality of the sheet discharging roller pairs 1 and a plurality of the stiffness imparting units 2 are disposed alternately in a width direction E of the sheet. In other words, the stiffness imparting units 2 include a first stiffness imparting unit and a second stiffness imparting unit which are disposed alternately with the sheet discharging roller pairs 1. Due to that, the sheet discharging apparatus 170 bends the sheet in the width direction E intersecting with the sheet discharging direction D to impart stiffness to the sheet. Accordingly, the stiffness imparting unit 2 prevents the sheet P from being stacked on the sheet discharge tray 180 in a state in which the front end part of the sheet P hangs down from the sheet discharging roller pair 1.

The configuration of the sheet discharging apparatus 170 will be described in detail below. As shown in FIG. 3, the sheet discharging roller pair 1 is composed of a discharge driving roller 1*a* rotating in a direction of an arrow J and a discharge driven roller 1*b* rotating in a direction of an arrow K. That is, the sheet discharging roller pair 1 is a roller pair in which these rollers are in pressure contact with each other. The stiffness imparting unit 2 includes a stiffness imparting frame 21, a sheet pressing lever 22, a sheet pressing roller 23, a compression spring 24, a stopper 22*a*, and a stopper receiver 21*a*. The stiffness imparting frame 21, i.e., a frame, is a skeletal structure member of the stiffness imparting unit 2 and is removably mounted to the apparatus body 100A by an attachment mechanism 30 described later. The sheet pressing lever 22 includes a turning shaft 25 supported by the stiffness imparting frame 21 and is turnable in a vertical direction Q intersecting with the sheet discharging direction D and the width direction E (see FIG. 5).

As shown in FIG. 6, the sheet pressing roller 23, i.e., a pressing portion, pressing the sheet P is rotatably supported by a supporting shaft 26 provided at an intermediate part of the sheet pressing lever 22. The sheet pressing roller 23 is arranged such that a lower end portion 23*a* (a lower outer circumferential part coming into contact with a sheet) thereof can press the sheet down in response to a turn of the sheet pressing lever 22 in the vertical direction Q. The sheet pressing roller 23 is positioned slightly upstream in the sheet discharging direction D of a nip NP between the discharge driving roller 1*a* and the discharge driven roller 1*b* in FIG. 3. The turning shaft 25 of the sheet pressing lever 22, the supporting shaft 26 supporting the sheet pressing roller 23, a rotation axis 1*aa* of the discharge driving roller 1*a*, and a rotation axis 1*ba* of the discharge driven roller 1*b* are in parallel with each other and orient in the width direction E of the sheet.

As shown in FIG. 3, the compression spring 24, i.e., a biasing member, applying a bias force to the sheet pressing roller 23 is attached compressively between a spring receiving portion 21*b* formed on the stiffness imparting frame 21 and the sheet pressing lever 22. Receiving a downward turning force from the compression spring 24, the sheet pressing lever 22 brings the sheet pressing roller 23 into pressure contact with the sheet. The sheet pressing lever 22 is also restricted from excessively turning downward by a stopper receiver 21*a* of the stiffness imparting frame 21 that receives a stopper 22*a* formed at a front end part of the sheet pressing lever 22.

Next, an operation of the sheet discharging apparatus 170 will be described. In FIG. 3, in a state in which no sheet P is conveyed into a vicinity of the nip NP, the sheet pressing lever 22 is restricted from turning downward because the stopper 22*a* abuts against the stopper receiver 21*a* due to own weights of the sheet pressing lever 22 and the sheet pressing roller 23 and a pressing force of the compression spring 24. At this time, the lower end portion 23*a* of the sheet pressing roller 23 is located at a level lower than a nip line NPL, i.e., a common tangential line of the discharge driving roller 1*a* and the discharge driven roller 1*b*.

When the sheet P is conveyed in the sheet discharging direction D in this state and arrives at the vicinity of the nip NP, the sheet P comes into contact with a lower part surface 22*b* of the sheet pressing lever 22 as shown in FIG. 4. Then, by being guided by the lower part surface 22*b*, the sheet P comes into contact with the outer circumference (lower end portion 23*a*) of the sheet pressing roller 23 and an outer circumference 1*bc* of the discharge driven roller 1*b*. Then, when the sheet P is conveyed further in the sheet discharging direction D, the sheet P passes through along the sheet pressing roller 23, which projects to the level lower than the lower part surface 22*b* of the sheet pressing lever 22, and arrives at the nip NP between the discharge driving roller 1*a* and the discharge driven roller 1*b*.

The sheet P that has arrived at the nip NP is conveyed in the sheet discharging direction D by the sheet discharging roller pair 1 and is discharged out of the apparatus body 100A to the space AR. At this time, the sheet P is bent in the width direction of the sheet as shown in FIG. 8 under downward pressure applied by the sheet pressing roller 23. This downward pressure is due to the pressing force of the compression spring 24 and the weights of the sheet pressing lever 22 and the sheet pressing roller 23. Therefore, the stiffness imparting unit 2 deflects a cross-sectional shape of the sheet P along the width direction E in a thickness direction (to a lower direction in FIG. 8) such that a part of the sheet different widthwise from the nip NP is displaced. As a result, the sheet P increases its stiffness (stiffened) and is discharged to the sheet discharge tray 180 in a state in which the sheet P is prevented from being otherwise stacked on the sheet discharge tray 180 in the condition in which the front end portion of the sheet hangs down from the sheet discharging roller pair 1. Because the stiffness of the sheet P is increased, the sheet P is stacked orderly on the sheet discharge tray 180. Then, the user takes out the sheet stacked on the sheet discharge tray 180 from the front side of the printer 100 (the side indicated by E in FIG. 5). That is, the user takes out the sheet so as to pull out in a right direction in FIG. 5.

In the configuration described above, the lower part surface 22*b* of the sheet pressing lever 22 is positioned at the level lower than the nip line NPL between the discharge driving roller 1*a* and the discharge driven roller 1*b*. With this arrangement, the sheet is guided by the sheet pressing lever 22 while being bent more or less in the width direction, hence the hence enter readily under the sheet pressing roller 23.

A suitable deflection amount is required for a low-stiffness sheet whose stiffness is low such as a thin paper in order to improve stackability of the sheet on the sheet discharge tray 180. Here, the deflection amount is a displacement amount of a sheet in the thickness direction and is equal to a vertical distance between the nip NP of the sheet discharging roller pair 1 and the lower end portion 23*a* of the sheet pressing roller 23 in the present embodiment. Meanwhile, because a high-stiffness sheet whose stiffness is high such as a thick paper does not require as much deflection as required for the low-stiffness sheet or requires almost no deflection. Then, it is necessary to cut a deflection amount of the high-stiffness sheet to be less than a deflection amount of the low-stiffness sheet.

Because the compression spring 24 is provided above the sheet pressing lever 22 as the biasing member in the present embodiment, the sheet pressing lever 22 retracts upward by resisting against the bias force of the compression spring 24 more in a case of conveying the high-stiffness sheet than a case of conveying the low-stiffness sheet. Accordingly, the sheet pressing lever 22 is configured to be able to change the deflection amount naturally depending on the stiffness of the sheet. Resilience of the compression spring 24 is set such that a significant difference is generated among the deflection amounts within a range of stiffness of the sheets P normally used. It is noted that the biasing member is not always required to be constructed by the compression spring. For instance, it is possible to adopt a magnetic member that biases the sheet pressing lever 22 downward by means of a magnetic force or the sheet may be deflected by own weights of the sheet pressing lever 22 and the sheet pressing roller 23.

By the way, the stiffness imparting unit 2 is removably attached to the apparatus body 100A by the attachment mechanism 30 shown in FIGS. 3, 4, 6, and 7. The stiffness imparting unit 2 is detached from the apparatus body 100A in the case when the stapler 202 is mounted on the sheet discharge tray 180. Besides that, the stiffness imparting unit 2 is detached from the apparatus body 100A in a case when the printer 100 forms an image on a thick high-stiffness sheet or in a case of maintaining the stiffness imparting unit 2 or the printer 100. It is noted that while the stiffness imparting units 2 are individually removed from and attached to the apparatus body in the present embodiment, it is also possible to configure such that the stiffness imparting units 2 are removably attached to the apparatus body concurrently as an integral member.

As shown in FIG. 5, each stiffness imparting unit 2 includes a projecting portion 28 projecting out of the apparatus body 100A in a state in which each stiffness imparting unit is attached to the apparatus body 100A. The projecting portion 28 projects downstream in the sheet discharging direction D of the sheet discharging roller pair 1 so as to overlap with the sheet stacking surface 180*a* of the sheet discharge tray 180 in a plan view as shown in FIG. 1. Accordingly, in the case when the stapler 202 is mounted on the sheet discharge tray 180, the projecting portion 28 intrudes into the space AR occupied by the stapler 202. Still further, the projecting portion 28 is a triangle plate-like member in a plan view and extends in the horizontal direction in parallel with the supporting part a2 of the sheet stacking surface 180*a*.

As described later, the projecting portion 28 has a function of preventing the stapler 202 from being erroneously attached. Still further, the projecting portion 28 is a part held by the user in attaching the stiffness imparting unit 2 to the apparatus body 100A so that the user can handle the stiffness imparting unit 2 integrally. The projecting portion 28 is also provided to let the user know that the stiffness imparting unit 2 is attached to the apparatus body 100A when the stapler 202 is mounted on the sheet discharge tray 180.

The attachment mechanism 30 is configured such that the stiffness imparting frame 21 of the stiffness imparting unit 2 is removably attached to the apparatus body 100A. Therefore, the respective components composing the attachment mechanism 30 are formed in the apparatus body 100A and the stiffness imparting frame 21. That is, the attachment mechanism 30 includes hooks 21*d*, an extension end portion 21*c*, and positioning projecting pieces 21*e* provided in the stiffness imparting frame 21 and engaged pieces 3, concave portions 4, and positioning pieces 5 provided in the apparatus body 100A.

Then, as shown in FIG. 7, disposed in the apparatus body 100A are the concave portions 4 heading downstream in the sheet discharging direction D at positions corresponding to the plurality of stiffness imparting units 2 and a beam 7 extending across an entire width of the sheet discharging apparatus (the direction E) orthogonal to the sheet discharging direction D. Disposed along the beam 7 are the engaged pieces 3 projecting upward and extending upstream in the sheet discharging direction D and disposed corresponding to both sides of the stiffness imparting unit 2 and the positioning pieces 5 each projecting in the sheet discharging direction D at an intermediate part between the pair of engaged pieces 3.

As shown in FIGS. 6 and 7, the stiffness imparting frame 21 is integrally formed with the projecting portion 28, the extension end portion 21*c* extending upstream in the sheet discharging direction D from a center part of the width direction E of the projecting portion 28, and the pair of hooks 21*d* located at both sides of the projecting portion 28 and elastically deformable. The stiffness imparting frame 21 is also integrally formed with the pair of positioning projecting pieces 21*e* projecting from an upper surface of the projecting portion 28. The extension end portion 21*c*, the pair of hooks 21*d*, and the pair of positioning projecting pieces 21*e* are formed to be in parallel with the sheet discharging direction D in a state when the stiffness imparting frame 21 is attached to the apparatus body 100A.

As described above, the respective components of the attachment mechanism 30 compose three attaching mechanisms 31, 32, and 33 in which the engage portions of the stiffness imparting unit 2 are combined with the engaged portions of the apparatus body 100A. These attaching mechanisms attach the stiffness imparting unit 2 to the apparatus body 100A and position them in the sheet discharging direction, the width direction, and the vertical direction in cooperation. The first mechanism 31 is composed of the pair of hooks 21*d* on the unit side and the pair of engaged pieces 3 on the body side. The second mechanism 32 is composed of the extension end portion 21*c* on the unit side and the concave portion 4 on the body side. The third mechanism 33 is composed of the pair of positioning projecting pieces 21*e* on the unit side and the positioning piece 5 on the body side.

A sheet discharge direction positioning portion 30A positioning the stiffness imparting unit 2 in the sheet discharging direction D is formed of the first and second mechanisms 31 and 32. That is, a position in the sheet discharging direction D of the stiffness imparting unit 2 is determined by releasably fitting the extension end portion 21*c* into the concave portion 4 and by disengageably engaging the pair of hooks 21*d* with the pair of engaged pieces 3.

A sheet widthwise positioning portion 30B positioning the stiffness imparting unit 2 in the width direction E is formed of the second and third mechanisms 32 and 33. That is, a position in the width direction E of the stiffness imparting unit 2 is determined by releasably fitting the extension end portion 21*c* into the concave portion 4 and by engaging the pair of positioning projecting pieces 21*e* with the both sides of the positioning piece 5.

A vertical positioning portion 30C positioning the stiffness imparting unit 2 in the vertical direction is formed of the first and second mechanisms 31 and 32 as shown in FIGS. 4 and 5. That is, a position in the vertical direction Q of the stiffness imparting unit 2 is determined by supporting the pair of hooks 21*d* by the beam 7 on the body side and by releasably fitting the extension end portion 21*c* into the concave portion 4.

Next, an attachment operation for attaching the stiffness imparting unit 2 to the apparatus body 100A will be described. The user can attach the stiffness imparting unit 2 to the apparatus body 100A by conducting a simple operation of moving (pushing in) the stiffness imparting unit 2 upstream in the sheet discharging direction D. The stiffness imparting unit 2 is readily attached to the apparatus body 100A by engaging the hooks 21*d* (first engage portion) of the first mechanism 31 with the engaged pieces 3 (first engaged portion) by elastically deforming the hooks 21*d*. Still further, engaging of the first mechanism 31 is accompanied by engaging of the second and third mechanisms 32 and 33. That is to say, the engage portions (second engage portions) of the second and third mechanisms 32 and 33 engage with the respective engaged portions (second engaged portions) in parallel with engaging of the first mechanism. With this configuration, the stiffness imparting unit 2 is naturally positioned.

This operation will be described below in detail step by step. At first, the user holds the projecting portion 28 by one hand and deflects the pair of hooks 21*d* in a direction of approaching with each other by another hand to move the stiffness imparting frame 21 upstream in the sheet discharging direction D. At this time, the sheet pressing lever 22 provided in the stiffness imparting frame 21 also moves upstream in the sheet discharging direction D together with the stiffness imparting frame 21. Then, the pair of hooks 21*d* is inserted between the pair of engaged pieces 3. About that time, the extension end portion 21*c* is inserted into the concave portion 4 such that the end surface 21*ca* of the extension end portion 21*c* approaches the rear face 4*a* of the concave portion 4. Still further, the positioning piece 5 is positioned between the pair of positioning projecting pieces 21*e*. Still further, the pair of hooks 21*d* is made to be supported on the beam 7. In this state, the user releases the pair of hooks 21*d*, which has been held and deflected in the direction of approaching with each other by the other hand. Then, the pair of hooks 21*d* expands between the pair of engaged pieces 3 by its own elasticity and engages with the pair of engaged pieces 3. That is, the stiffness imparting frame 21 of the stiffness imparting unit 2 is attached to the apparatus body 100A by this time. The user releases the projecting portion 28 held by the other hand. As a result, the stiffness imparting unit 2 is positioned without shifting positions in the three directions of the sheet discharging direction D, the width direction E, and the vertical direction Q by the sheet discharge direction positioning portion 30A, the sheet widthwise positioning portion 30B, and the vertical positioning portion 30C described above.

In the attachment mechanism 30 described above, the extension end portion 21*c* and the concave portion 4 support, by its engagement, the one end portion of the stiffness imparting frame 21 and the sheet pressing lever 22 and prevent the positional shift of the stiffness imparting unit 2. That is, the engagement of the extension end portion 21*c* and the concave portion 4 prevents the positional shift in the width direction E and the vertical direction Q of a part where a turning shaft 25, i.e., a center of turn of the sheet pressing lever 22, is provided in the stiffness imparting unit 2. It is also possible to restrict the positional shift in the sheet discharging direction D of the stiffness imparting unit 2 during turn of the sheet pressing lever 22 by the abutment of the end surface 21*ca* of the extension end portion 21*c* and the rear face 4*a* of the concave portion 4 and by the engagement of the pair of hooks 21*d* with the pair of engaged pieces 3. Therefore, the sheet pressing lever 22 can prevent positional shift of the sheet pressing roller 23 through the turning shaft 25 and can impart adequate stiffness corresponding to the stiffness of the sheet. It is noted that in FIGS. 3, 4, and 6, a gap G, which is required in engaging the pair of hooks 21*d* with the pair of engaged pieces 3 by deflecting the hooks 21*d* in the direction of approaching with each other, is formed between the end surface 21*ca* of the extension end portion 21*c* and the rear face 4*a* of the concave portion 4.

When the user takes the stiffness imparting unit 2 out of the apparatus body 100A, the user holds the projecting portion 28 by one hand and releases the engagement with the pair of engaged pieces 3 by deflecting the pair of hooks 21*d* in the direction of approaching with each other by the other hand. Then, while holding the projecting portion 28 by the one hand, the user moves the stiffness imparting frame 21 in the sheet discharging direction D and releases the pair of hooks 21*d* held by the other hand. Then, the user pulls the pair of hooks 21*d* out of the pair of engaged pieces and the pair of positioning projecting pieces out of the positioning pieces 5 respectively in the sheet discharging direction D. Thus, the stiffness imparting unit 2 can be taken out of the apparatus body 100A. It is noted that the user may take the stiffness imparting unit 2 out of the apparatus body 100A by pulling the held stiffness imparting unit 2 in the sheet discharging direction D while disengaging the pair of hooks 21*d* from the pair of engaged pieces 3 by deflecting the pair of hooks 21*d* so as to approach with each other by using only one hand.

It is noted that the configuration for removably attaching the stiffness imparting unit 2 to the apparatus body 100A is not limited to what described above. For instance, the stiffness imparting unit 2 may be held not only by what holds by a mechanical holding force but also by what holds by using a magnetic force. Still further, the respective attaching mechanisms 31, 32, and 33 may be replaced such that those on the body side are replaced with those on the unit side. That is, the extension end portion 21*c*, the hook 21*d*, and the positioning projecting piece 21*e* may be formed on one of the stiffness imparting frame 21 and the apparatus body 100A, and the concave portion 4, the positioning piece 5, and the positioning projecting piece 21*e* may be formed on the other of the stiffness imparting frame 21 and the apparatus body 100A.

By the way, the projecting portion 28 extends from the apparatus body 100A above the sheet discharge tray 180 while facing the sheet stacking surface 180*a* (see FIG. 1) of the sheet discharge tray 180. Therefore, if the user reaches his/her hand to the space AR on the sheet discharge tray in taking out the sheet discharged on the sheet discharge tray without watching the sheet discharge tray, there is concern that the hand touches the projecting portion 28 and the stiffness imparting unit is removed or damaged. In a case in which an upper part of the sheet discharge tray 180 is covered by the image reading apparatus 300 and a sheet to be taken out is hardly visible in particular, there is a case when the user inserts the hand gropingly into the space AR and touches the projecting portion 28.

Then, the sheet discharging apparatus 170 of the present embodiment is provided with an inclined surface 28*a* inclined on a side portion on a front side of the projecting portion 28 (see FIGS. 6 and 7) such that the closer to the downstream side in the sheet discharging direction D, the closer to a center side in the width direction E of the projecting portion 28. Therefore, if the user extends his/her hand gropingly to the space AR and touches the inclined surface 28*a* of the projecting portion 28, an abutment force F1 normal to the inclined surface 28*a* acts on the projecting portion 28. The abutment force F1 is dispersed into a component force F11 (<F1) in a direction inverse to the sheet discharging direction D and a component force F12 (<F1) in parallel with a hand intrusion direction (the width direction E of the sheet). It is then possible to prevent the projecting portion 28 from being damaged by dispersing an interference force of the hand acting on the projecting portion 28. Still further, because the projecting portion 28 is pressed to the apparatus body 100A side by the component force F11 in the direction inverse to the sheet discharging direction D, it is possible to prevent the hooks 21*d* formed in the stiffness imparting frame 21 integrated with the projecting portion 28 from being disengaged from the engaged portions 3. That is, it is possible to prevent the stiffness imparting unit 2 from being detached from the apparatus body 100A.

Still further, there is a case when the user hits his/her hand against a side portion on a rear side of the projecting portion 28 when the user inserts the hand into the space AR to hold a sheet on the sheet discharge tray 180 to take out to the front side. Here, on the side portion on the rear side of the projecting portion 28 is formed an inclined surface 28*b*, which is inclined such that the closer to the downstream side in the sheet discharging direction D, the closer to the center side in the width direction E of the projecting portion 28. Therefore, even if the hand hits against the inclined surface 28*b*, an abutment force F2 is dispersed into component forces F21 and F22, similarly to the component forces F11 and F12. Accordingly, it is possible to prevent the projecting portion 28 from being damaged and the stiffness imparting unit 2 from being detached from the apparatus body 100A.

It is noted that the inclined surface may be formed only on either one of the both side portions in the width direction E of the projecting portion 28. Besides that, the projecting portion 28 may be formed into a convex polygonal shape in which all interior angles are obtuse angles or a whole side surface of the projecting portion 28 may be composed of a smooth curved surface, e.g., a semi-circular plate member, projecting in the sheet discharging direction D in a plan view. In short, the similar advantageous effect with the present embodiment can be obtained as long as a profile of the projecting portion 28 is defined by a convex curve projecting downstream in the sheet discharging direction D.

Still further, as shown in FIG. 2, the stapler, i.e., the sheet processing device, 202 can be mounted on the sheet discharge tray 180. The stapler 202 often has a structure in which internal mechanisms thereof are densely disposed to downsize the stapler. Even more, a sheet guide path 201 guiding a sheet is disposed so as to weave through the internal mechanisms and is often curved at a plurality of spots. Therefore, it is difficult for the sheet to which stiffness has been imparted by the sheet discharging apparatus 170 to pass through the sheet guide path 201 having such many curved spots, and there is a possibility that the sheet is jammed in the sheet guide path 201 or the image is damaged even if the sheet passes through the sheet guide path 201. Then, in the case when the stapler 202 is mounted on the sheet discharge tray 180, it is preferable to separate the stiffness imparting unit 2 from the sheet discharging apparatus 170 and to convey the sheet from the sheet discharging apparatus to the stapler without deflecting the sheet. This is another reason for that the stiffness imparting unit 2 of the present embodiment is detached from the sheet discharging apparatus 170 with the attachment mechanism 30 and to be taken out of the apparatus body 100A.

Accordingly, the sheet discharging apparatus 170 is configured such that the stapler 202 can be mounted on the sheet discharge tray 180 after when the user takes the stiffness imparting unit 2 out of the apparatus body 100A. This arrangement makes it possible to prevent the sheet from jamming or the image of the sheet from being damaged within the stapler. Still further, the sheet discharging apparatus can enhance efficiency of its sheet discharging process by preventing the sheet from jamming within the stapler.

Still further, because the printer 100 of the present embodiment includes the sheet discharging apparatus 170 preventing the sheet from jamming or the image formed on the sheet from being damaged, the printer 100 can provide a sheet on which a high quality image has been formed.

By the way, the replacement of the stiffness imparting unit 2 and the stapler 202 is made manually by the user. Therefore, there may be a case when the user erroneously tries to mount the stapler 202 on the sheet discharge tray 180 in the state in which the stiffness imparting unit 2 is assembled in the sheet discharging apparatus 170. Then, the sheet discharging apparatus 170 of the present embodiment is configured such that the stapler 202 interferes with the projecting portion 28 if the stapler 202 is tried to be mounted on the sheet discharge tray 180 in the state in which the stiffness imparting unit 2 is assembled in the sheet discharging apparatus 170. Therefore, even if the user tries to mount the stapler 202 without recognizing the existence of the stiffness imparting unit 2, the stapler 202 interferes with the projecting portion 28. This arrangement makes it possible to prevent the stiffness imparting unit 2 from being forgotten to be taken out of the apparatus body 100A in advance and to insure that the stapler 202 is mounted in a state in which the stiffness imparting unit 2 is taken out of the apparatus body 100A.

As described above, the sheet discharging apparatus 170 of the present embodiment is configured to be able to prevent the user from erroneously mounting the stapler 202 on the sheet discharge tray 180 in the state in which the stiffness imparting unit 2 is kept assembled in the sheet discharging apparatus 170. Accordingly, the sheet discharging apparatus 170 of the present embodiment prevents the sheet from jamming or the image on the sheet from being damaged within the stapler more securely and can enhance the efficiency of the sheet discharging process.

By the way, it is also conceivable that the stapler 202 collides against the projecting portion 28 if the stapler 202 is erroneously inserted into the space AR to mount on the sheet discharge tray 180 in the state in which the stiffness imparting unit 2 is assembled in the sheet discharging apparatus 170. Here, the inclined surface 28*a* is formed at the front side portion in the sheet discharging direction D of the projecting portion 28. Therefore, the stapler 202 abuts against the inclined surface 28*a* at the front side of the projecting portion 28. An abutment force F1 normal to the inclined surface 28*a* acts on the projecting portion 28 as described above. That is, the abutment force F1 is dispersed into a component force F11 (<F1) and a component force F12 (<F1). It is possible to prevent the projecting portion 28 from being damaged because an impact force of the stapler 202 acting on the projecting portion 28 is dispersed as described above. Still further, because the projecting portion 28 is pressed to the apparatus body 100A side by the component force F11 in the direction inverse to the sheet discharging direction D, the hooks 21*d* formed on the stiffness imparting frame 21 integrated with the projecting portion 28 are prevented from being disengaged from the engaged pieces 3. That is, the stiffness imparting unit 2 is prevented from being detached from the apparatus body 100A.

As described above, the sheet discharging apparatus 170 is configured such that the projecting portion 28 blocks the stapler 202 from being mounted if the stapler 202 is tried to be mounted on the sheet discharge tray 180 in the state in which the stiffness imparting unit 2 is attached. Therefore, the sheet discharging apparatus 170 is configured to remove the stiffness imparting unit 2 when the stapler 202 is mounted to convey the sheet to the stapler 202 without imparting stiffness to the sheet. As a result, the sheet discharging apparatus 170 can prevent the sheet from jamming within the sheet processing device.

By the way, the stapler 202 is mounted on the stacking surface of the sheet discharge tray 180 in the embodiment described above. That is, it has been exemplified a mode that the stapler 202 is located in the space AR to which the sheet is discharged while supported on the stacking surface of the sheet discharge tray 180. However, in a case when it is difficult to adapt the stacking surface of the sheet discharge tray 180 to a bottom shape of the stapler 202, the following arrangement may be made for example. That is, the sheet discharge tray 180 is removed from the sheet discharging apparatus 170. Then, the stapler 202 mounted in the space AR to which the sheet is discharged is supported by a member to which the sheet discharge tray 180 has been attached.

It is noted that sheet processing devices other than the stapler, such as a punching device for punching holes in a sheet, a sheet folding device for folding a sheet, are also mountable on the sheet discharge tray 180. A buffer, which is configured to store sheets received from the sheet discharging apparatus and send these sheets to devices optionally connected on a side of the printer 100 such as a stapler and a sheet punching device, is also mountable on the sheet discharge tray 180. Accordingly, a sheet processing device is not limited to be the stapler.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-010226, filed on Jan. 22, 2015, 2015-010227, filed on Jan. 22, 2015, and 2015-255186, filed on Dec. 25, 2015, which are hereby incorporated by reference herein in their entirety.

What is claimed is:

1. A sheet discharging apparatus comprising:

an apparatus body;

a discharge unit configured to convey a sheet in a sheet discharging direction so as to discharge the sheet;

a sheet stacking portion comprising a stacking surface on which the sheet discharged by the discharge unit is stacked, the sheet stacking portion being configured such that a sheet processing device configured to process the sheet discharged by the discharge unit is mountable; and an attachment unit removably attached to the apparatus body, the attachment unit comprising:

(1) a pressing portion pressing the sheet to bend the sheet in a width direction intersecting with the sheet discharging direction; and (2) a projecting portion projecting from the apparatus body, the projecting portion being configured to project downstream of the pressing portion in the sheet discharging direction and being disposed at a position where at least a part of the projecting portion overlaps with the stacking surface in a plan view.

2. The sheet discharging apparatus according to claim 1, wherein one widthwise side portion of the projecting portion comprises an inclined surface inclined such that the closer to the downstream side in the sheet discharging direction, the closer to another side in the width direction.

3. The sheet discharging apparatus according to claim 1, wherein both widthwise side portions of the projecting portion comprise inclined surfaces inclined such that the closer to the downstream side in the sheet discharging direction, the closer to each other in the width direction.

4. The sheet discharging apparatus according to claim 1, wherein the projecting portion comprises a profile defined by a convex curve projecting downstream in the sheet discharging direction in a plan view, the convex curve comprising at least one of a smooth curve and a polygonal shape whose adjacent line segments form an obtuse angle.

5. The sheet discharging apparatus according to claim 1, wherein the stacking surface comprises a supporting part being in contact with a bottom of the sheet processing device and supporting the sheet processing device, and wherein the projecting portion is a plate member in parallel with the supporting part.

6. The sheet discharging apparatus according to claim 1, wherein the attachment unit comprises an engage portion, wherein the apparatus body comprises an engaged portion engaged with the engage portion so as to restrict a removal of the attachment unit from the apparatus body, and wherein at least one of the engage portion and the engaged portion is elastically deformable so that an engagement between the engage portion and the engaged portion is released.

7. The sheet discharging apparatus according to claim 6, wherein the engage portion comprises a first engage portion and a second engage portion, wherein the engaged portion comprises (1) a first engaged portion engaged with the first engage portion and (2) a second engaged portion engaged with the second engage portion, wherein the first engage portion engages with the first engaged portion while being deformed elastically, in an attachment operation of moving the attachment unit upstream in the sheet discharging direction toward the apparatus body, and wherein the second engage portion engages with the second engaged portion to position the attachment unit in the attachment operation, accompanying the first engage portion engaging with the first engaged portion.

8. An image forming apparatus comprising:

an image forming unit forming an image on a sheet; and the discharging apparatus as set forth in claim 1, the sheet discharging apparatus discharging the sheet on which the image has been formed by the image forming unit.

9. The sheet discharging apparatus according to claim 1, wherein the projecting portion intrudes into a space to be occupied by the sheet processing device mounted on the sheet stacking portion.

10. A sheet discharging apparatus comprising:

an apparatus body;

a discharge unit configured to convey a sheet in a sheet discharging direction to discharge the sheet;

a sheet stacking portion comprising a stacking surface on which the sheet discharged by the discharge unit is stacked, the sheet stacking portion being configured such that a sheet processing device configured to process the sheet discharged by the discharge unit is mountable; and an attachment unit removably attached to the apparatus body, the attachment unit comprising a pressing portion pressing the sheet to bend the sheet in a width direction intersecting with the sheet discharging direction, wherein at least a part of the attachment unit intrudes into a space to be occupied by the sheet processing device mounted on the sheet stacking portion.

11. The sheet discharging apparatus according to claim 1, wherein pressing portion comprises a roller member configured to rotate in contact with the sheet.

12. The sheet discharging apparatus according to claim 1, further comprising a second attachment unit provided in parallel with the attachment unit, wherein the discharge unit comprises a plurality of roller pairs respectively forming nips nipping and conveying the sheet, and wherein the attachment unit and the second attachment unit are disposed alternately with the roller pairs in the width direction.

13. The sheet discharging apparatus according to claim 1, wherein the attachment unit further comprises a biasing member biasing the pressing portion such that the pressing portion comes into pressure contact with the sheet to deflect the sheet in a thickness direction, and wherein the biasing member causes less deflection in a case when the discharge unit discharges a high-stiffness sheet whose stiffness is higher than a low-stiffness sheet, as compared to a case when the discharge unit discharges a low-stiffness sheet.

14. The sheet discharging apparatus according to claim 13, wherein the attachment unit further comprises (1) a frame supported by the apparatus body and (2) a swing portion supporting the pressing portion and swingable in a sheet thickness direction with respect to the frame, and wherein the biasing member comprises a compression spring compressed between the frame and the swing portion.

15. The sheet discharging apparatus according to claim 10, wherein the attachment unit comprises an operation portion configured to be operated in a case where the attachment unit is removed from the apparatus body.

16. The sheet discharging apparatus according to claim 15, wherein the attachment unit comprises an engage portion elastically deformable and configured such that the operation portion is a part of the engage portion, wherein the apparatus body comprises an engaged portion engaged with the engage portion so as to restrict a removal of the attachment unit from the apparatus body, and wherein the engage portion is configured to be disengaged from the engaged portion while being elastically deformed by pressing operation of the operation portion, so that the attachment unit can be removed from the apparatus body.

17. The sheet discharging apparatus according to claim 10, further comprising a second attachment unit provided in parallel with the attachment unit, wherein the discharge unit comprises a plurality of roller pairs respectively forming nips nipping and conveying the sheet, and wherein the attachment unit and the second attachment unit are disposed alternately with the roller pairs in the width direction.

18. The sheet discharging apparatus according to claim 10, wherein the attachment unit further comprises a biasing member biasing the pressing portion such that the pressing portion comes into pressure contact with the sheet to deflect the sheet in a thickness direction, and wherein the biasing member causes less deflection in a case when the discharge unit discharges a high-stiffness sheet whose stiffness is higher than a low-stiffness sheet, as compared to a case when the discharge unit discharges a low-stiffness sheet.

19. The sheet discharging apparatus according to claim 10, wherein at least a part of the pressing portion is located within the apparatus body in a state where the attachment unit is attached to the apparatus body.

20. An image forming apparatus comprising:

an apparatus body;

an image forming unit forming an image on a sheet;

a sheet discharging unit configured to convey the sheet on which the image has been formed by the image forming unit in a sheet discharge direction so as to discharge the sheet; and a sheet stacking portion comprising a stacking surface on which the sheet discharged by the sheet discharging apparatus is stacked, wherein the apparatus body is configured such that an attachment unit is removably attached, the attachment unit comprising:

(1) a pressing portion pressing the sheet to bend the sheet in a width direction intersecting with the sheet discharging direction; and (2) a projecting portion projecting out of the apparatus body, the projecting portion being configured to project downstream of the pressing portion in the sheet discharging direction and being disposed at a position where at least a part of the projecting portion overlaps with the stacking surface in a plan view, and wherein the apparatus body is configured such that a sheet processing device processing the sheet discharged by the sheet discharging apparatus is mounted on the sheet stacking portion in a state in which the attachment unit is taken out of the apparatus body.

* * * * *